US009501037B2

(12) United States Patent
Silvant

(10) Patent No.: US 9,501,037 B2
(45) Date of Patent: Nov. 22, 2016

(54) ROTATING BEZEL SYSTEM

(71) Applicant: Omega SA, Neuchatel (CH)

(72) Inventor: Olivier Silvant, Macolin (CH)

(73) Assignee: Omega SA, Neuchatel (CH)

( * ) Notice: Subject to any disclaimer, the term of this patent is extended or adjusted under 35 U.S.C. 154(b) by 26 days.

(21) Appl. No.: 14/405,939

(22) PCT Filed: May 31, 2013

(86) PCT No.: PCT/EP2013/061274
§ 371 (c)(1),
(2) Date: Dec. 5, 2014

(87) PCT Pub. No.: WO2013/182487
PCT Pub. Date: Dec. 12, 2013

(65) Prior Publication Data

US 2015/0185702 A1 Jul. 2, 2015

(30) Foreign Application Priority Data

Jun. 6, 2012 (EP) ..... 12171072

(51) Int. Cl.
*G04B 19/28* (2006.01)

(52) U.S. Cl.
CPC ..... *G04B 19/283* (2013.01)

(58) Field of Classification Search
CPC .. G04B 19/283; G04B 19/286; G04B 37/00; G04B 37/08; G04B 37/0008
USPC ..... 368/295
See application file for complete search history.

(56) References Cited

U.S. PATENT DOCUMENTS

| | | | | |
|---|---|---|---|---|
| 3,271,945 | A * | 9/1966 | Anderson | G04B 19/166 368/22 |
| 5,122,997 | A * | 6/1992 | Schneider | G04B 19/283 368/294 |
| 5,319,617 | A * | 6/1994 | Sonoda | G04B 19/283 368/294 |
| 5,541,895 | A * | 7/1996 | Nussbaum | G04B 19/283 368/295 |
| 6,599,009 | B2 * | 7/2003 | Terasawa | G04B 19/283 368/294 |
| 7,134,784 | B1 * | 11/2006 | Marin | G04B 19/283 368/238 |
| 2001/0040840 | A1 * | 11/2001 | Terasawa | G04B 19/283 368/295 |

(Continued)

FOREIGN PATENT DOCUMENTS

| | | |
|---|---|---|
| CH | 703 400 | 1/2012 |
| EP | 0 403 717 | 12/1990 |

(Continued)

OTHER PUBLICATIONS

International Search Report Issued Nov. 4, 2013 in PCT/EP13/061274 Filed May 31, 2013.

*Primary Examiner* — Amy Cohen Johnson
*Assistant Examiner* — Jason Collins
(74) *Attorney, Agent, or Firm* — Oblon, McClelland, Maier & Neustadt, L.L.P.

(57) ABSTRACT

A timepiece case band including a peripheral shoulder in which an annular rotating bezel system is rotatably mounted. The rotating bezel system is an independent module including an annular bezel, an annular support element, a toothed element, and a spring mechanism cooperating elastically with a snap-fit mechanism, the spring mechanism and the toothed element being axially retained by the bezel and/or the support element. The rotating bezel system further includes a securing mechanism securing the spring mechanism, support element, and bezel to each other.

26 Claims, 6 Drawing Sheets

(56) References Cited

U.S. PATENT DOCUMENTS

| | | | | |
|---|---|---|---|---|
| 2003/0099165 | A1* | 5/2003 | Terasawa | G04B 19/283 368/294 |
| 2003/0123332 | A1* | 7/2003 | Hiranuma | G04B 19/283 368/295 |
| 2004/0141424 | A1* | 7/2004 | Hartmann | G04B 19/283 368/295 |
| 2006/0114753 | A1* | 6/2006 | Gerber | G04B 19/283 368/295 |

FOREIGN PATENT DOCUMENTS

| | | |
|---|---|---|
| EP | 1 431 845 | 6/2004 |
| EP | 1 835 363 | 9/2007 |
| GB | 2 234 369 | 1/1991 |

* cited by examiner

ROTATING BEZEL SYSTEM

CROSS-REFERENCE TO RELATED APPLICATIONS

This a National phase application in the United States of International patent application PCT/EP2013/061274 filed May 31, 2013 which claims priority on European patent application No. 12171072.7 filed Jun. 6, 2012. The entire disclosures of the above patent applications are hereby incorporated by reference.

The present invention concerns a timepiece comprising a case band closed by a back cover and a crystal, said timepiece further comprising a rotating bezel system secured to said case band.

The technical field of the invention is the technical field of fine mechanics.

BACKGROUND OF THE INVENTION

The present invention concerns a rotating bezel for a timepiece.

Known rotating bezel systems include an annular rotating bezel having a top surface and a bottom surface, with the top surface being the surface visible to the user. This bezel has notches or toothing on the bottom surface thereof. The rotating bezel system further includes a spring means. This spring means is inserted between the rotating bezel and the case band of the timepiece when the bezel is snap-fitted onto the case band of the timepiece. This spring means takes the form of a flat ring comprising leaves on the surface thereof facing the notches in the bezel. These leaves are arranged to tilt between 0° and 90° relative to the plane of the flat ring. The leaves have some elasticity so that the spring means acts on the rotating bezel to exert a vertical force. This vertical force has a tendency to push the bezel off the case band of the timepiece.

The leaves also serve to cooperate with the notches in the bezel. The leaves and catch are thus configured so that the bezel can only rotate in one direction. Generally, the bezel and the spring means are made of steel which has the advantage of being durable and inexpensive.

The same concept is used for making a bezel made of precious materials. However, the precious materials have unsuitable mechanical characteristics, such as for example low mechanical resistance. A snap-fit arrangement using precious materials thus has the drawback of being subject to rapid wear. A solution consists in making a snap fit arrangement which is added to the bezel. This arrangement makes it possible to have a bezel made of precious material but wherein the snap fit is accomplished using materials with a long service life. The drawback of this solution is that it requires a more complex manufacturing method since the snap-fit arrangement must be made separately and then fixed to the bottom surface of the bezel.

Further, rotating bezel systems have the drawback of being difficult to assemble to the case band since the spring means must be mounted first. The bezel is then assembled afterwards. Thus, not only is the assembly complex, but disassembly is virtually impossible and is liable to destroy the rotating bezel.

The whole forms a rotating bezel system of the prior art. These systems also have an unattractive operating noise which is bothersome for high end timepieces.

SUMMARY OF THE INVENTION

It is an object of the invention to overcome the drawbacks of the prior art by providing a rotating timepiece bezel system which is simpler to produce, which can be made of precious materials without exhibiting premature wear and which can be disassembled.

To this end, the invention concerns a timepiece case band including a peripheral shoulder on which an annular rotating bezel system is rotatably mounted, characterized in that said rotating bezel system is formed of an independent module, said module including an annular bezel, an annular support element, a toothed element and spring means cooperating resiliently with the toothed element, said spring means and said toothed element being axially retained by the bezel and the support element, said rotating bezel system further including securing means for securing the spring means, the support element and the bezel to each another, the toothed element being angularly integral with said case band, whereas the spring means are angularly integral with the bezel and with the support element so that the spring means, the bezel and the support element can rotate together allowing the position of the rotating bezel system to be indexed with respect to the case band.

A first advantage of the present invention is that the rotating bezel system according to the present invention is simpler to make and to assemble. Indeed, the fact of mounting the ring on a support piece so as to place the spring ring and the toothing between said support piece and the bezel makes it possible to have an independent module: this module improves the manufacturing process, since the rotating bezel modules can be mounted separately. Since the toothing is arranged to be secured to the watch case band, the support piece and the spring are integral with each other.

Further, this arrangement makes it possible to make bezels from precious materials with no risk of premature wear since the toothing is not integrated in the bezel and is simply secured to said bezel. Indeed, the rotating bezel system is arranged so that the spring and the toothing are inserted between the bezel and the support piece, the spring and the toothing cooperating with each other.

In a first embodiment, the toothed element and the spring means are concentric to each other.

In a second embodiment, the bezel and the support element are arranged so that both exhibit a complementary profile such that the assembly of the bezel to the support element defines a first housing in which the toothed element are the spring means are placed.

In a third embodiment, the toothed element is formed of a toothed ring including a toothing, the spring means including a spring ring which includes elastic means capable of cooperating with the toothing arranged on said toothed element.

In a fourth embodiment, the toothed ring and the spring ring are flat coplanar rings.

In another embodiment, the toothed ring includes a toothing on the outer surface thereof and is angularly integral with the case band, the spring ring being integral with the bezel and with the support element, and including on the inner surface thereof, the elastic means being able to cooperate with the toothing arranged on said toothed ring.

In another embodiment, the elastic means are arms extending towards the interior of the spring ring so as to exert a pressure on the toothing.

In another embodiment, the case band includes a lateral wall in which there is arranged a raised portion to form a groove so that a protuberance arranged on the support element can cooperate with said groove and limit the vertical motion of the rotating bezel system.

In another embodiment, the toothed ring includes at least one lug and the lateral wall of the case band includes at least one recess arranged so that said at least one lug can be inserted therein to limit the angular motion of the toothed ring with respect to the case band.

In another embodiment, the toothed ring includes three lugs.

In another embodiment, the spring ring includes three angularly distributed elastic arms.

The present invention also concerns a timepiece case band including a peripheral shoulder on which an annular rotating bezel system is rotatably mounted, characterized in that said rotating bezel system is formed of an independent module, said module including an annular bezel, an annular support element, a toothed element and spring means cooperating elastically with said notches, said spring means and said toothed element being axially held by the bezel and/or the support element, said rotating bezel system further including securing means for securing the toothed element, the support element and the bezel to each other, the spring means being angularly integral with said case band, whereas the toothed element is angularly integral with the bezel and with the support element to allow the position of the rotating bezel system to be indexed with respect to the case band.

In a first embodiment, the toothed element and the spring means are concentric to each other.

In a third embodiment, the toothed element is formed of a toothed ring including a toothing, the spring means including a spring ring which includes elastic means able to cooperate with the toothing arranged on said toothed element.

In another embodiment, the spring ring is open and has at least one area having a minimum radius and one area having a maximum radius so that the area of maximum radius cooperates with a recess arranged in said support element and so that the area of minimum radius cooperates with a groove arranged in the case band.

In another embodiment, said spring ring comprises two ends, one of which has a raised portion, said raised portion comprising an axially oriented curved portion and a flat portion parallel to said spring ring, and said flat portion includes, on the outer surface thereof, the toothing cooperating with the toothed element.

In another embodiment, the bezel and the support element are arranged so that both have a complementary profile so that the assembly of the bezel to the support element forms a second housing in which the toothed element is placed, said support element including a recess into which the spring means are inserted.

The present invention further concerns a timepiece including a case formed by a case band closed by a back cover and a crystal, characterized in that the case band is the case band according to any of the preceding claims.

BRIEF DESCRIPTION OF THE DRAWINGS

The objects, advantages and features of the bezel system according to the present invention will appear more clearly in the following detailed description of at least one embodiment of the invention, given solely by way of non-limiting example and illustrated by the annexed drawings, in which.

DETAILED DESCRIPTION OF THE INVENTION

The present invention proceeds from the general inventive idea which consists in providing a rotating bezel system which is simpler to assemble.

A rotating bezel system is fixed to a case band having a central axis (C). The rotating bezel system also includes an annular bezel, which is the part visible to and handled by the user, and a support element which is also annular. The rotating bezel system also includes a toothed element placed between the bezel and the support element. Finally, the rotating bezel system includes spring means cooperating with the toothed element to allow the rotating bezel system to rotate with respect to the watch case band, to index the position of the bezel with respect to the case band. This rotation is possible because the toothed element or the spring means are angularly integral with said case band.

Figure 1:
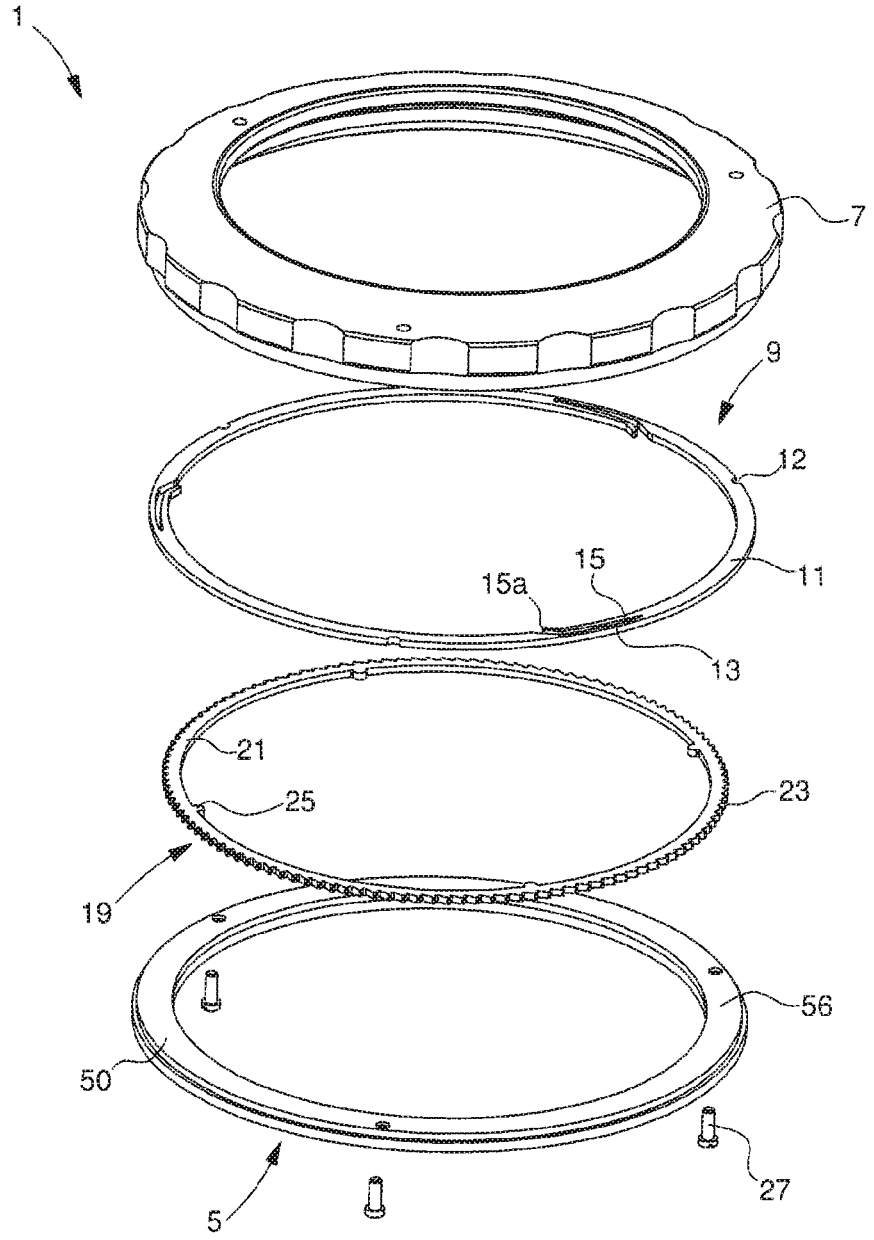
FIG. 1 shows an exploded view of the rotating bezel system according to the present invention.

FIG. 1 shows the rotating bezel system 1 according to a first embodiment of the invention in an exploded view to show each part separately.

In this first embodiment, the rotating bezel system includes a bezel 7, which is the part visible to and handled by the user. This annular bezel includes a top surface 7*a* visible to the user and a bottom surface 7*b*. The rotating bezel system 1 further includes a support or pre-assembly element 5 taking the form of an annular ring. This support element 5 includes a flat ring 50 having a top surface 52 and a bottom surface 54. Top surface 52 includes a first peripheral rim 56. Bottom surface 54 includes a second peripheral rim 58 and a third rim 60 close to the inner end of ring 50. Second rim 58 and third rim 60 thus define an annular housing 62. The third rim 60 includes at least one protuberance 64 extending towards the central axis of ring 50. Preferably, third rim 60 includes a single protuberance covering the whole of said rim 60.

Figure 2:
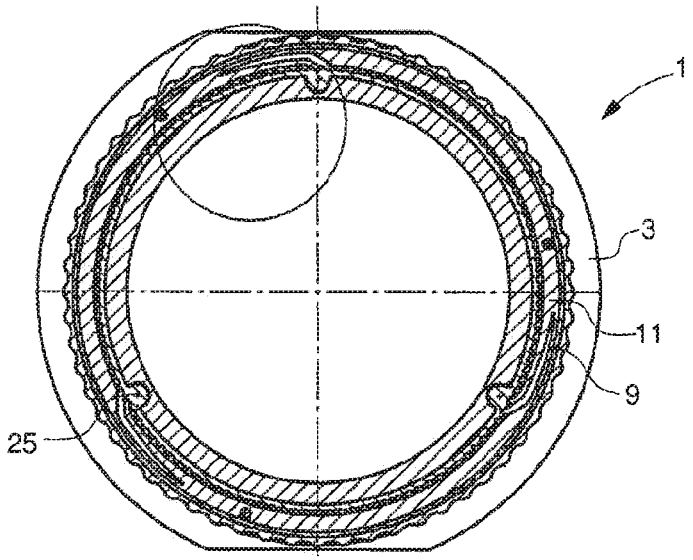
FIGS. 2 and 3 show a bottom view and a partial enlargement of this view of the rotating bezel system according to the present invention.
Figure 3:
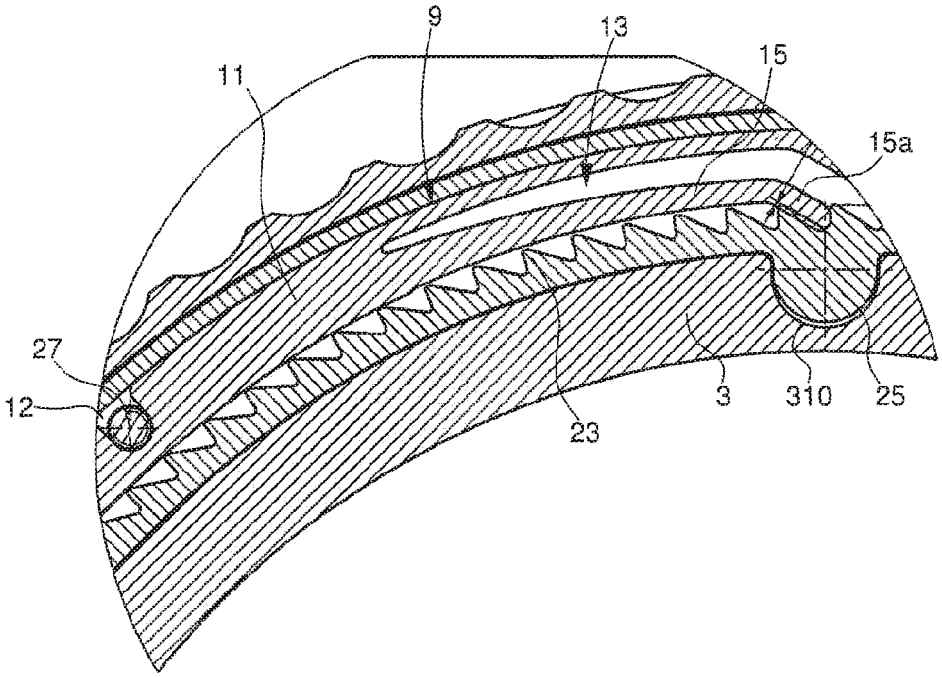
Figure 4:
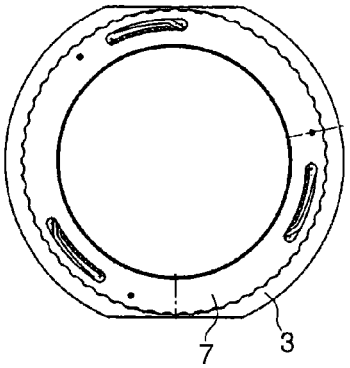
FIG. 4 shows a top view of the rotating bezel according to the present invention.

The rotating bezel system 1, seen in FIGS. 2 to 4, further includes a spring-catch assembly 10 or catch fit system. This spring-catch 10 assembly includes spring means 9 and a toothed element 19. Spring means 9 include a ring 11 provided with elastic means 13. These elastic means 13 take the form, for example, of elastic arms 15 arranged in ring 11 so that the arms do not protrude therefrom. These arms 15 are arranged, at the free end thereof, to tilt towards the interior of spring ring 9. Each arm 15 is formed by making a notch in said spring ring 11 so that a recess 17 appears between each arm 15 and the body of ring 11. The thickness of each arm 15 decreases towards end 15*a*. In the present example, the spring ring includes 3 elastic arms angularly distributed at 120° intervals.

Indeed, toothed element 19 includes a toothed ring 21 whose outer wall 21*a* is provided with a toothing 23 and whose inner wall 21*b* has lugs or protuberances 25, which are three in number here. This toothed element 19 is arranged to be inserted into spring means 9, i.e. toothed ring 21 is sized to be able to placed in said spring ring 11.

Toothed ring 21 and spring ring 11 are concentric and coplanar. When toothed ring 21 is inserted inside spring ring 11, this configuration allows elastic means 13 to cooperate with toothing 23 as a result of the tilt of arms 15. In this configuration, each arm 15 is in contact with toothing 23 so that there is a rest position in which the end 15*a* of each arm 15 is in a hollow of toothing 23. This tilt of arm 15 towards the interior of spring ring 11 is used to allow the unidirectional rotation of spring ring 11 with respect to toothed ring 21. Toothing 23 and elastic means 13 are arranged so that spring ring 11 can rotate with respect to toothed ring 21 in a defined direction: clockwise or anticlockwise. Of course, it is possible for toothing 23 and elastic means 13 to be arranged so that spring ring 11 can rotate in one and/or the other of the two directions: clockwise or anticlockwise.

This spring-catch assembly 10 is then placed on the top surface 52 of support element 5. This support element 5 and bezel 7 are secured to each other via securing means 27 such as, for example, screws, and then define a first housing 51 in which spring means 9 and toothed element 19 are placed. Securing means 27 then passes through spring-catch assembly 10. To accomplish this, support element 5, bezel 7 and said spring-catch assembly 10 include apertures 12 allowing said securing means 27 to pass therethrough. These apertures 12 are arranged on spring ring 11. Consequently, this spring ring 11 becomes integral with support element 5 and with bezel 7. Securing means 27 may also be an adhesive or rivets or other means.

Figure 5:
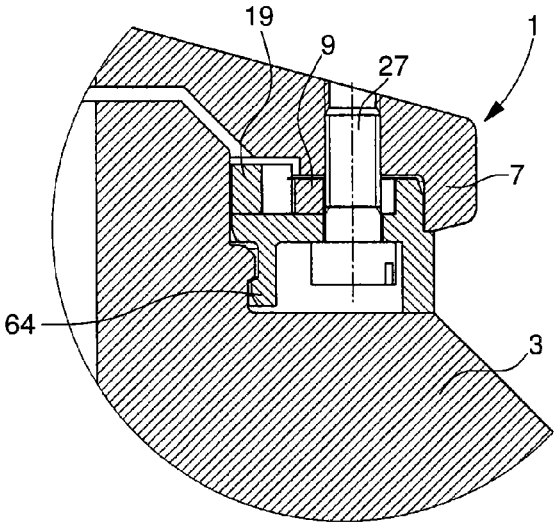
FIGS. 5 and 6 show profile views of the rotating bezel system according to the present invention.
Figure 6:
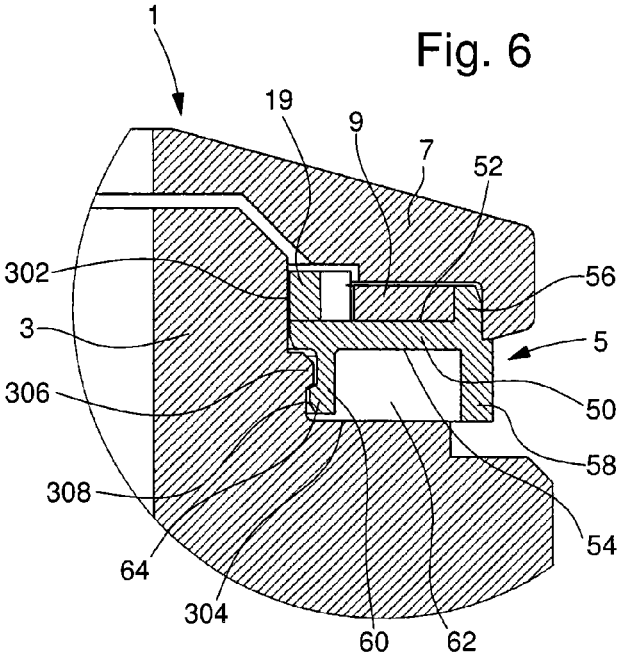

The bezel system is then assembled to a timepiece as seen in FIGS. 5 and 6. This timepiece includes a case band 3. This case band 3 includes a shoulder 300 defined by a lateral wall 302 and a base 304. This shoulder 300 serves as a housing for rotating bezel system 1. Lateral wall 302 includes a raised portion 306 extending over the entire perimeter of lateral wall 302. This raised portion 306 defines, in cooperation with base 304 and wall 302, a support groove 308. This support groove 308 allows protuberance 64 to be inserted therein, during the assembly of rotating bezel system 1 onto case band 3. This insertion is a forcible insertion so that rotating bezel system 1 is retained vertically to case band 3.

The lugs 25 or protuberances of toothed ring 21 are used to secure said rotating bezel system to the timepiece.

The case band further includes at least one recess 310. In said example, three recesses 310 are made, the number of recesses 310 being identical to that of lugs 25. Indeed, these recesses 310, arranged on lateral wall 302, have an identical or substantially identical shape to that of lugs 25 of inner wall 21*b* of toothed ring 21. During the assembly of rotating bezel system 1 to the case band 3 of the timepiece, each of lugs 25 is inserted in a recess 310 of case band 3. The purpose of these recesses 310 is to lock the rotating bezel system 1 in rotation with respect to case band 3.

In fact, said rotating bezel system 1 is axially secured, vertically to case band 3 by protuberance 64 inserted into support groove 308. However, the rotating bezel system 1 is not locked in rotation and can therefore rotate with respect to case band 3 when the user turns the bezel. Only the friction force between wall 302 and base 304 of case band 3 and the outer walls of rotating bezel system 1 acts to prevent such a rotation.

With lugs 25 inserted in the recesses of the series of recesses, toothed ring 21 is prevented from rotating with respect to case band 3. This toothed ring 21 thus rotates integrally with the case band. Since this toothed ring 21 is inserted into rotating bezel system 1 and cooperates with spring ring 11, only the assembly formed of the rotating bezel, of spring ring 11 and of support element 5 can be rotated with respect to the case band.

As previously stated, toothing 23 and spring means 13 are arranged to define the direction of rotation of rotating bezel 7 with respect to toothed ring 21, i.e. with respect to case band 3. When the user grips bezel 7 and turns it, two distinct reactions can occur.

First, the user turns bezel 7 in the opposite direction to the desired direction and the bezel does not turn. Indeed, elastic arms 15 are formed so that the end 15*a* of each arm 15 impedes rotation. When the rotation of bezel 7 and thus of spring ring 11 is not in the correct direction, the tilt of arms 15 causes end 15*a* to press on toothing 23 so that arm 15 cannot pass over the top of toothing 23. The more the user turns bezel 7 and thus spring ring 11 in the wrong direction the greater the pressure exerted by end 15*a* on toothing 23. This makes it impossible for the bezel to rotate. Specifically, arms 15 have a bent shape at the end 15*a* thereof so that the end will press on the hollow between two notches. Locking can be improved by bending end 15*a* of each arm 15 so that the curvature of said end 15*a* matches the shape of the notches of toothing 23.

Secondly, when the bezel is turned in the direction in which it is intended to rotate, it rotates. Indeed, in this case, bezel 7 and thus spring ring 11 are rotated in the right direction in which arms 15 do not impede rotation since, in this direction, the end 15*a* of arms 15 does not press on toothing 23. It is the notches of toothing 23 which press on arms 15. These elastic arms 15 move radially towards spring ring 11 until arms 15 enter in contact with said spring ring 11.

Thus, by changing the orientation of elastic arms 15, it is possible to change the direction of rotation of the bezel. If arms 15 are oriented in the clockwise direction, bezel 7 will be unidirectional in the opposite direction to the clockwise direction and vice versa. This configuration may be accomplished simply by turning the spring ring over so as to change the direction of the elastic arms. Further, rotating bezel system 1 may be two-directional by producing elastic arms which do not exert pressure on toothed ring 21 when the user turns bezel 7. To accomplish this, it may be provided that arms 15 extend radially so that the arms do not exert pressure on toothing 23 in either direction of rotation. A pre-assembled rotating bezel system which is easy to adjust is therefore obtained.

An advantage of this rotating bezel system 1 is that it enables rotating bezels to be easily made of precious materials. Indeed, toothed ring 21 is independent of the bezel, i.e. it is not secured thereto. Thus, there is no specific constraint. The bezel may, consequently, be made of precious materials without this causing manufacturing problems, since toothed ring 21 and spring ring 11 are still made of steel, i.e. of materials exhibiting less wear than precious materials.

Figure 7:
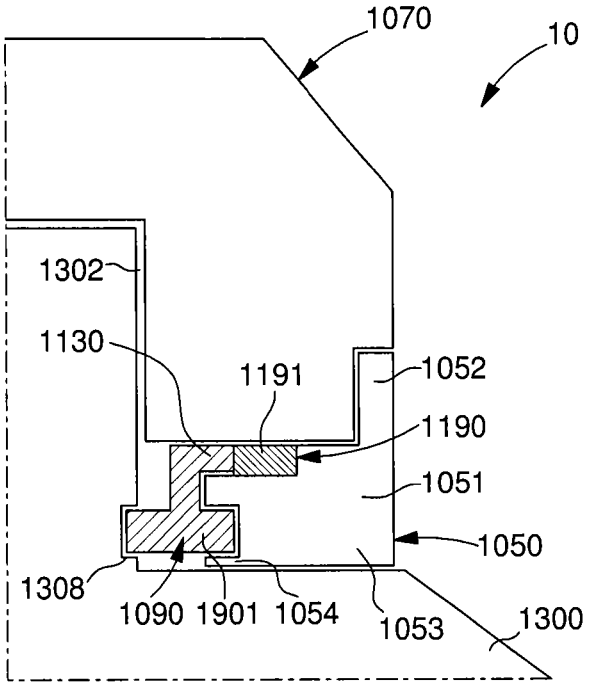
FIG. 7 shows a cross-section of a second embodiment of the rotating bezel system according to the present invention.

In a second embodiment seen in FIG. 7, rotating bezel system 1 includes a bezel 1070, which is the part visible to and handled by the user. This annular bezel includes a top surface visible to the user and a bottom surface. The rotating bezel system 1 further includes a support element 1050. This support element 1050 includes a flat ring 1051 having a top surface and a bottom surface. The top surface includes a first peripheral rim 1052 having a stair-shaped profile. It is thus clear that said rim has several levels or support surfaces. As a minimum, the first peripheral rim 1052 will include at least an intermediate level, and support element 1050 therefore includes three support surfaces at three different heights. The bottom surface includes a second peripheral rim 1053. The latter has a recess 1054 covering the inner surface of second rim 1053 so as to form a circular recess. Bezel 1070 also has a stair-shaped profile, but inverted. This stair-shaped profile is arranged to cooperate with the profile of support element 1050.

Figure 9:
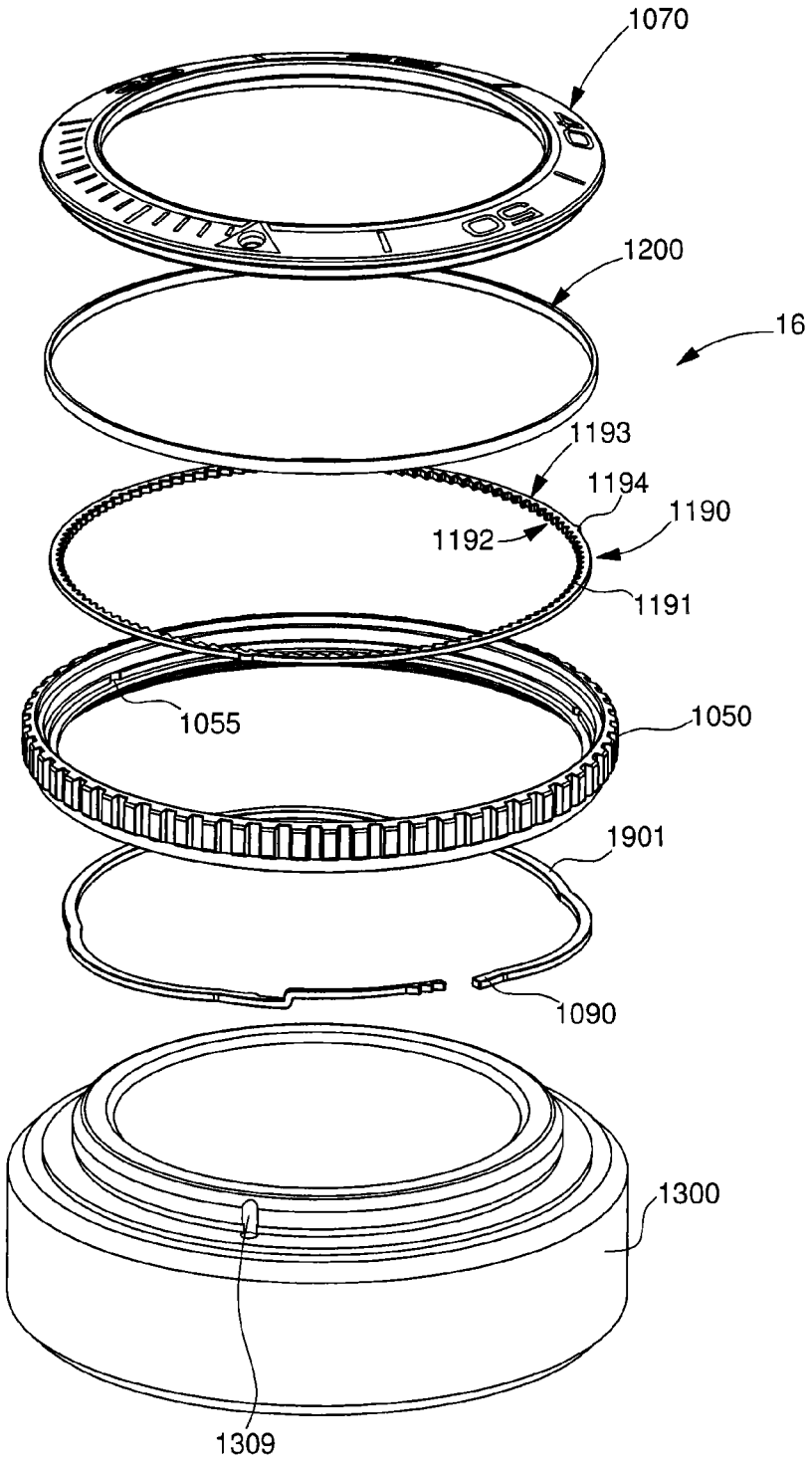

Rotating bezel system 10, seen in FIGS. 7 and 9, further includes a spring-catch assembly. This spring-catch assembly includes spring means 1090 and a toothed element 1190. The toothed element 1190 includes a toothed ring 1191 whose inner wall includes a toothing 1192 and whose outer wall 1193 includes lugs or protuberances 1194, which are three in number here. This toothed element 1190 is arranged to be inserted into support element 1050. More specifically, toothed ring 1191 is placed on the lowest support surface. In order to angularly lock toothed element 1190, support element 1050 includes hollows 1055. The number of these hollows 1055 is equal to the number of lugs or protuberances 1194 on the outer wall 1193 of toothed ring 1191. Hollows 1055 are arranged so that, when toothed ring 1191 is placed in support element 1050, the lugs or protuberances 1194 are inserted into said hollows 1055, thereby angularly locking said toothed ring 1191. Bezel 1070 is then secured to the support element. During this assembly, the inverted stair-shaped profile of bezel 1070 cooperates with the stair-shaped profile of support element 1050. The dimensions of these profiles are calculated so that the inverted stair-shaped profile of bezel 1070 and the stair-shaped profile of support element 1050 fit together forming a second housing 116 into which the toothed element can be inserted. Bezel 1070 consequently presses on toothed element 1190 so as to hold them securely in support element 1050. Bezel 1070 may be driven or screwed or bonded in.

Figure 10:
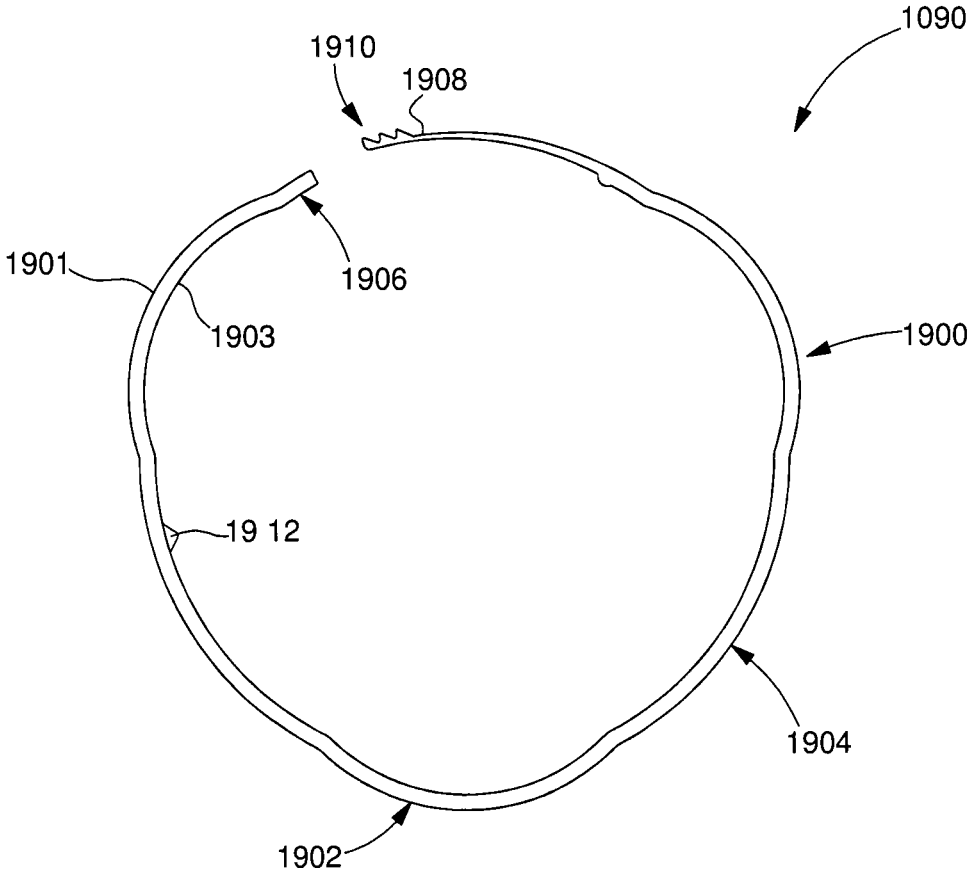
FIG. 10 shows a top view of the spring ring of the rotating bezel system according to the present invention.

Spring means 1090 include a spring ring 1900 which may or may not be open having an outer wall 1901 and an inner wall 1903. The spring ring 1900 comprises at least one area having a smaller radius of curvature 1902 than the radius of curvature of said non-closed ring. It is thus clear that said spring ring 1900 includes at least one area 1904 having a maximum radius and at least one area 1902 having a minimum radius. In the case shown in FIGS. 9 and 10, spring ring 1900 includes three regularly, angularly spaced areas having a smaller radius of curvature 1902 than the radius of curvature of said non-closed ring. Said non-closed ring also has, at one of the ends 1906 thereof, a raised portion 1908. This means that said end 1906 has a curved portion 1906*a*, having an axial or vertical curvature so that the end 1906 is raised, and a flat portion 1906*b* parallel to the plane of spring ring 1901.

A toothing 1910, intended to cooperate with toothing 1192 of toothed ring 1191, is arranged on outer wall 1901 of raised portion 1908. In fact, when spring ring 1900 is mounted in rotating bezel system 10, said spring ring 1900 is inserted into the circular hollow 1054 of second rim 1053. The raised height of raised portion 1908 is then calculated so that the latter is opposite toothed ring 1191. Consequently, toothing 1910 of outer surface 1901 of raised portion 1908 comes into contact with toothing 1192 of the inner face of toothed ring 1191. This cooperation makes it possible to determine the direction of rotation of rotating bezel 10. To achieve this, toothing 1910 of raised portion 1908 and the toothing 1192 of the inner surface of toothed ring 1191 are configured such that each tooth includes an inclined surface and a surface that merges with the radius of toothed ring 1191 or of spring ring 1901. When spring ring 1901 is mounted in rotating bezel system 10, the inclined surface of each tooth of the spring ring toothing is supported on the inclined surface of each tooth of toothing 1192 of toothed ring 1191. The rotation of system 10 is unidirectional, i.e. rotation can occur in the clockwise direction or the anti-clockwise direction; however it is possible for rotation to be two-directional.

Spring ring 1901 is devised so that once installed in support element 1050, only the areas 1902 whose radius of curvature is smaller than the radius of curvature of the spring ring are disposed in the circular hollow 1054 of the second rim 1053, which is due to the fact that these areas are further from the centre of spring ring 1900 than the rest of said ring.

An advantage of this arrangement is that it provides a rotating bezel system 1 that can be pre-assembled which facilitates the final assembly of the watch.

When rotating bezel system 10 is assembled on watch case band 1300, driving in said rotating bezel system 10 causes stress to be applied to spring means 1090. The result of this stress is an increase in the diameter of spring ring 1901, the latter tending to fully enter circular hollow 1054 of second rim 1053 which facilitates the driving in operation.

When spring ring 1901 is facing groove 1308 located on case band 1300, the stress exerted on said spring ring 1901 decreases. The spring ring relaxes to return to its initial position. As the areas of the spring ring furthest from the centre 1904 of said spring ring relax, they are inserted into groove 1308 of case band 1300 to ensure vertical retention.

Moreover, the spring ring has at least one protuberance 1912 on the inner surface 1903 thereof. This protuberance 1912 is arranged to cooperate with a recess 1309 located on case band 1300. This recess 1309 is positioned such that protuberance 1912 is inserted therein when the rotating bezel system 10 is mounted on the case band. This cooperation result in the angular locking of spring ring 1901 with respect to case band 1300.

There is thus obtained a spring ring 1901, which is angularly integral with case band 1300, and an assembly formed by bezel 1070, support element 1050 and toothed element 1191, which can rotate about case band 1300 in at least one predetermined direction. Indeed, when the user decides to rotate rotating bezel system 10, he has two possibilities: either he rotates rotating bezel system 10 in the direction in which it is intended to rotate, or in the opposite direction. Depending on the direction in which the user rotates the bezel, the teeth of the spring ring and the teeth of toothed ring 1191 slide over each other to mesh or press on each other to impede rotation.

One advantage of the rotating bezel system according to this second embodiment of the invention is that it is easier to assemble on the case band since the stress to be exerted is lower. Indeed, in known systems 10, vertical retention is achieved by driving in a rigid element which requires exerting a significant force to drive in rotating bezel system 10. This also means that the operation of detaching rotating bezel system 10 from case band 3 is very complicated, since there is a significant risk of said system breaking. The rotating bezel system according to the invention uses an elastic element to ensure vertical retention. It is spring ring 1901 which is used for vertical or axial retention and which is deformed during the driving in operation. The stress that has to be applied to assemble rotating bezel system 10 of the invention to the case band is thus lower. Consequently, this makes it possible for the operation of removing the rotating bezel system from the case band to be less complicated and the risk of breaking said rotating bezel system to be lower.

An advantage common to both the embodiments is that the choice of the direction of rotation of the rotating bezel system can easily be changed by replacing spring ring 11, 1901 and toothed ring 21, 1191 in the rotating bezel system.

Figure 8:
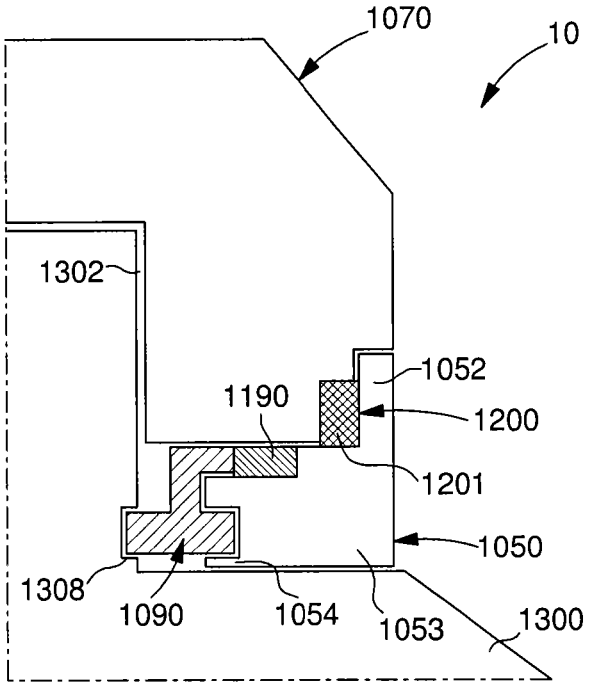
FIGS. 8 and 9 show, respectively, a cross-sectional view and an exploded view of a variant of the second embodiment of the rotating bezel system according to the present invention.

In a variant of the second embodiment seen in FIG. 8, support element 1050 further includes a sealing element 1200. Indeed, where the bezel is used in a diver's watch or simply to protect said bezel from water infiltration, a sealing gasket 1201 is placed in rotating bezel system 10 to seal the system. For this purpose, the profile of support element 1050 has an additional intermediate level, i.e. an additional support surface. This additional support surface is used for inserting the sealing gasket. This sealing gasket 120 is then compressed between bezel 1070 and support element 1050. Preferably, the additional intermediate level is sized so that, when sealing gasket 1201 is inserted, the profile of the support element with the gasket is identical to the profile of support element 1050 of the second embodiment, i.e. without the sealing gasket. This means that it is only support element 1050, and not the bezel, which is modified.

It will be clear that various alterations and/or improvements and/or combinations evident to those skilled in the art may be made to the various embodiments of the invention set out above without departing from the scope of the invention defined by the annexed claims.

The invention claimed is:

1. An annular rotating bezel system configured to be rotatably mounted on a peripheral shoulder of a timepiece case band, the rotating bezel system comprising:

a pre-assembled module, the module including an annular bezel, an annular support element positioned below the annular bezel, a toothed element, and spring means cooperating elastically with the toothed element, the spring means and the toothed element being axially retained between the bezel and the support element;

securing means for securing the spring means, the support element, and the bezel to each another;

the toothed element being angularly integral with the case band, whereas the spring means are angularly integral with the bezel and with the support element so that the spring means, the bezel, and the support element can rotate together allowing a position of the rotating bezel system to be indexed with respect to the case band.

2. The rotating bezel system according to claim 1, wherein the toothed element and the spring means are concentric to each other.

3. The rotating bezel system according claim 2, wherein the bezel and the support element are arranged so that both have a complementary profile so that an assembly of the bezel to the support element defines a first housing in which the toothed element and the spring means are placed.

4. The rotating bezel system according claim 1, wherein the bezel and the support element are arranged so that both have a complementary profile so that an assembly of the bezel to the support element defines a first housing in which the toothed element and the spring means are placed.

5. The rotating bezel system according to claim 1, wherein the toothed element includes a toothed ring including a toothing, the spring means including a spring ring including elastic means configured to cooperate with the toothing of the toothed ring.

6. The rotating bezel system according to claim 5, wherein the toothed ring and the spring ring are flat coplanar rings.

7. The rotating bezel system according to claim 6, wherein the toothed ring includes a toothing on an outer surface thereof and is angularly integral with the case band, the spring ring being integral with the bezel and with the support element and including, on an inner face thereof, the elastic means configured to cooperate with the toothing arranged on the toothed element.

8. The rotating bezel system according to claim 7, wherein the elastic means is arms extending towards the interior of the spring ring to exert a pressure on the toothing.

9. The rotating bezel system according to claim 8, wherein the spring ring includes 3 angularly distributed elastic arms.

10. The rotating bezel system according to claim 5, wherein the toothed ring includes a toothing on an outer surface thereof and is angularly integral with the case band, the spring ring being integral with the bezel and with the support element and including, on an inner face thereof, the elastic means configured to cooperate with the toothing arranged on the toothed element.

11. The rotating bezel system according to claim 10, wherein the elastic means is arms extending towards an interior of the spring ring to exert a pressure on the toothing.

12. The rotating bezel system according to claim 11, wherein the shoulder includes a lateral wall, parallel to the central axis of the case band, in which is arranged a raised portion forming a groove so that a protuberance arranged on the support element can cooperate with the groove and limit axial motion of the rotating bezel system.

13. The rotating bezel system according to claim 11, wherein the spring ring includes 3 angularly distributed elastic arms.

14. A timepiece comprising a case formed by a case band closed by aback cover and a crystal, wherein the case band includes the rotating bezel system according to claim 11.

15. The rotating bezel system according to claim 5, wherein the toothed ring includes at least one lug and a lateral wall of the case band includes at least one recess arranged so that the at least one lug is inserted therein to limit angular motion of the toothed ring with respect to the case band.

16. The rotating bezel system according to claim 15, wherein the toothed ring includes 3 lugs.

17. An annular rotating bezel system configured to be rotatably mounted on a peripheral shoulder of a timepiece case band, wherein the rotating bezel system comprises:

a pre-assembled module, the module including an annular bezel, an annular support element positioned below the annular bezel, a toothed element positioned on a top surface of the support element, and spring means cooperating elastically with notches, the spring means and the toothed element being axially retained by the bezel and/or the support element;

securing means for securing the toothed element, the support element, and the bezel to each other;

the spring means being angularly integral with the case band, whereas the toothed element is angularly integral with the bezel and with the support element to allow a position of the rotating bezel system to be indexed with respect to the case band.

18. The rotating bezel system according to claim 17, wherein the toothed element and the spring means are concentric to each other.

19. The rotating bezel system according to claim 18, wherein the toothed element includes a toothed ring including a toothing, the spring means including a spring ring which includes elastic means configured to cooperate with the toothing arranged on the toothed element.

20. The rotating bezel system according to claim 19, wherein the spring ring is open and includes at least one area having a minimum radius and one area having a maximum radius so that the area of maximum radius cooperates with a hollow arranged in the support element and so that the area of minimum area cooperates with a groove arranged on the case band.

21. The rotating bezel system according to claim 20, wherein the spring ring comprises two ends one of which has a raised portion, the raised portion including a vertically oriented curved portion and a flat portion parallel to the spring ring, and the flat portion includes, on an outer face thereof, the toothing cooperating with the toothed element.

22. The rotating bezel system according to claim 18, wherein the bezel and the support element are arranged so that both have a complementary profile so that an assembly of the bezel to the support element forms a housing in which the toothed element is placed, the support element including a hollow in which the spring means are inserted.

23. A timepiece comprising a case formed by a case band closed by a back cover and a crystal, wherein the case band includes the rotating bezel system according to claim 18.

24. The rotating bezel system according to claim 17, wherein the toothed element includes a toothed ring including a toothing, the spring means including a spring ring which includes elastic means configured to cooperate with the toothing arranged on the toothed element.

25. The rotating bezel system according to claim 24, wherein the spring ring is open and includes at least one area having a minimum radius and one area having a maximum radius so that the area of maximum radius cooperates with a hollow arranged in the support element and so that the area of minimum area cooperates with a groove arranged on the case band.

26. The rotating bezel system according to claim 25, wherein the spring ring comprises two ends one of which has a raised portion, the raised portion including a vertically oriented curved portion and a flat portion parallel to the spring ring, and the flat portion includes, on an outer face thereof, the toothing cooperating with the toothed element.

* * * * *